US010316673B2

(12) United States Patent
Weaver

(10) Patent No.: US 10,316,673 B2
(45) Date of Patent: Jun. 11, 2019

(54) CMC TURBINE BLADE PLATFORM DAMPER

(71) Applicant: General Electric Company, Schenectady, NY (US)

(72) Inventor: Matthew Mark Weaver, Loveland, OH (US)

(73) Assignee: General Electric Company, Schenectady, NY (US)

( * ) Notice: Subject to any disclaimer, the term of this patent is extended or adjusted under 35 U.S.C. 154(b) by 403 days.

(21) Appl. No.: 15/079,072

(22) Filed: Mar. 24, 2016

(65) Prior Publication Data

US 2017/0275999 A1 Sep. 28, 2017

(51) Int. Cl.
*F01D 5/22* (2006.01)
*F01D 5/28* (2006.01)
*F01D 5/10* (2006.01)

(52) U.S. Cl.
CPC ..... *F01D 5/22* (2013.01); *F01D 5/282* (2013.01); *F01D 5/10* (2013.01); *F05D 2250/11* (2013.01); *F05D 2260/96* (2013.01)

(58) Field of Classification Search
USPC ..... 416/190
See application file for complete search history.

(56) References Cited

U.S. PATENT DOCUMENTS 5,261,790 A 11/1993 Dietz et al.
5,785,499 A 7/1998 Houston et al.
7,121,800 B2 10/2006 Beattie
7,510,379 B2 3/2009 Marusko et al.
7,534,090 B2 5/2009 Good et al.
9,194,238 B2 11/2015 Roberts, III et al.
2012/0237352 A1* 9/2012 Boyer ..... F01D 5/22 416/221
2013/0052032 A1* 2/2013 Fachat ..... F01D 5/225 416/241 R
2013/0064668 A1 3/2013 Paige, II et al.
2013/0287583 A1* 10/2013 Schoenhoff ..... F01D 5/22 416/223 R
2014/0023506 A1 1/2014 Kleinow
2014/0065433 A1 3/2014 Lau et al.
2014/0079529 A1* 3/2014 Kareff ..... F01D 25/06 415/1
2014/0119943 A1* 5/2014 Tarczy ..... F01D 5/3069 416/96 R
2014/0147276 A1 5/2014 Roberts, III et al.
2016/0047260 A1* 2/2016 McCaffrey ..... F01D 11/006 416/223 A
2017/0067346 A1* 3/2017 Kareff ..... F01D 5/22

OTHER PUBLICATIONS

Giridhar, Gas Turbine Blade Damper Optimization Methodology, Advances in Acoustics and Vibration, vol. 2012, Article ID 316761, Jan. 10, 2012, 13 pages.

* cited by examiner

*Primary Examiner* — John Fox
(74) *Attorney, Agent, or Firm* — Dority & Manning, P.A.

(57) ABSTRACT

Damping systems are provided for a rotor blade platform. The damping system may include a blade platform defining a damper pocket and a CMC wedge damper positioned within the damper pocket. The CMC wedge damper has at least one damper angled surface parallel to a longitudinal axis. The damper pocket comprises a pocket angled surface positioned about the at least one damper angled surface.

13 Claims, 6 Drawing Sheets

CMC TURBINE BLADE PLATFORM DAMPER

FIELD OF THE INVENTION

The present disclosure generally involves damping vibrations in a turbine. In particular embodiments, the damping system may be used to damp vibrations on the platforms of adjacent rotating blades made from ceramic matrix composite (CMC) materials using a CMC wedge damper.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and the rotating blades may be attached to a rotor located along an axial centerline of the turbine. A compressed working fluid, such as steam, combustion gases, or air, flows along a hot gas path through the turbine to produce work. The stator vanes accelerate and direct the compressed working fluid onto the subsequent stage of rotating blades to impart motion to the rotating blades, thus turning the rotor and performing work.

Each rotating blade generally includes an airfoil connected to a platform that defines at least a portion of the hot gas path. The platform in turn connects to a root that may slide into a slot in the rotor to hold the rotating blade in place. Alternately, the root may slide into an adaptor which in turn slides into the slot in the rotor. At operational speeds, the rotating blades may vibrate at natural or resonant frequencies that create stresses in the roots, adaptors, and/or slots that may lead to accelerated material fatigue. Therefore, various damper systems have been developed to damp vibrations between adjacent rotating blades. In some damper systems, a metal rod or damper is inserted between adjacent platforms, adjacent adaptors, and/or between the root and the adaptor or the rotor. At operational speeds, the weight of the damper seats the damper against the complementary surfaces to exert force against the surfaces and damp vibrations.

Higher operating temperatures generally result in improved thermodynamic efficiency and/or increased power output. Higher operating temperatures also lead to increased erosion, creep, and low cycle fatigue of various components along the hot gas path. As a result, ceramic material composite (CMC) materials are increasingly being incorporated into components exposed to the higher temperatures associated with the hot gas path.

However, as CMC materials become incorporated into the airfoils, platforms, and/or roots of rotating blades, the ceramic surfaces of the rotating blades more readily abrade with conventional metallic dampers. The increased abrasion of the CMC material by the metallic dampers may create additional foreign object debris along the hot gas path and/or reduce the mass of the dampers, reducing the damping force created by the dampers. Therefore, an improved system for damping vibrations in a turbine would be useful.

BRIEF DESCRIPTION OF THE INVENTION

Aspects and advantages of the invention will be set forth in part in the following description, or may be obvious from the description, or may be learned through practice of the invention.

Damping systems are generally provided for a rotor blade platform. In one embodiment, the damping system includes a blade platform defining a damper pocket and a CMC wedge damper positioned within the damper pocket. The CMC wedge damper has at least one damper angled surface parallel to a longitudinal axis. The damper pocket comprises a pocket angled surface positioned about the at least one damper angled surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figures, in which.

Figure 1:
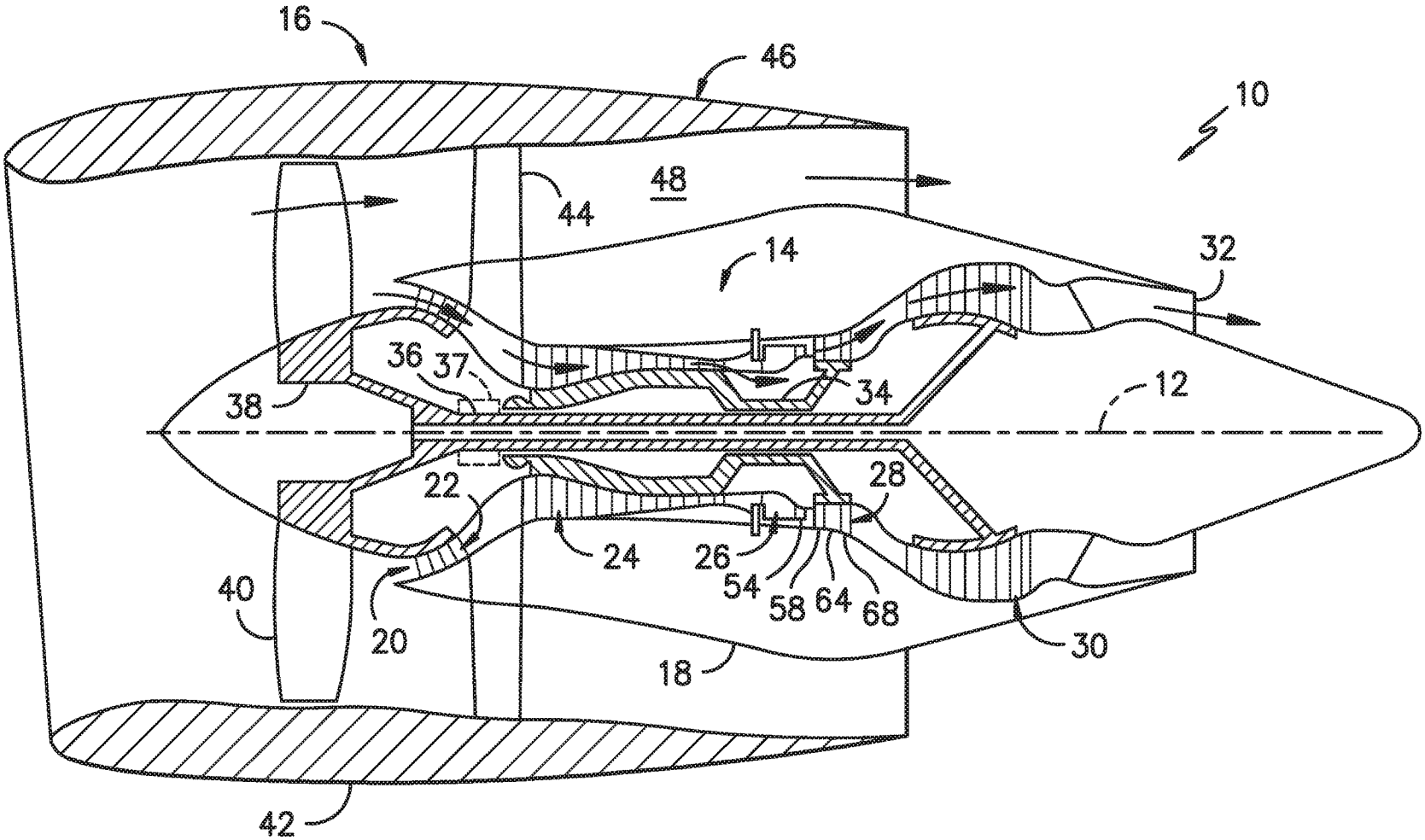
FIG. 1 is a schematic cross-sectional view of an exemplary gas turbine engine in accordance with an embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, the terms "axial" or "axially" refer to a dimension along a longitudinal axis of an engine. The term "forward" used in conjunction with "axial" or "axially" refers to moving in a direction toward the engine inlet, or a component being relatively closer to the engine inlet as compared to another component. The term "aft" used in conjunction with "axial" or "axially" refers to moving in a direction toward the engine exhaust nozzle, or a component being relatively closer to the engine exhaust nozzle as compared to another component.

As used herein, the terms "radial" or "radially" refer to a dimension extending between a center longitudinal axis of the engine and an outer engine circumference. The use of the terms "proximal" or "proximally," either by themselves or in conjunction with the terms "radial" or "radially," refers to moving in a direction toward the center longitudinal axis, or a component being relatively closer to the center longitudinal axis as compared to another component. The use of the terms "distal" or "distally," either by themselves or in conjunction with the terms "radial" or "radially," refers to moving in a direction toward the outer engine circumference, or a component being relatively closer to the outer engine circumference as compared to another component. As used herein, the terms "lateral" or "laterally" refer to a dimension that is perpendicular to both the axial and radial dimensions.

All directional references (e.g., radial, axial, proximal, distal, upper, lower, upward, downward, left, right, lateral, front, back, top, bottom, above, below, vertical, horizontal, clockwise, counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

Referring now to the drawings, FIG. 1 is a schematic cross-sectional view of an exemplary high-bypass turbofan type engine 10, herein referred to as "turbofan", as may incorporate various embodiments of the present disclosure. As shown in FIG. 1, the turbofan 10 has a longitudinal or axial centerline axis 12 that extends therethrough for reference purposes. In general, the turbofan 10 may include a core turbine or gas turbine engine 14 disposed downstream from a fan section 16.

The gas turbine engine 14 may generally include a substantially tubular outer casing 18 that defines an annular inlet 20. The outer casing 18 may be formed from multiple casings. The outer casing 18 encases, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The (LP) spool 36 may also be connected to a fan spool or shaft 38 of the fan section 16. In particular embodiments, the (LP) spool 36 may be connected directly to the fan spool 38 such as in a direct-drive configuration. In alternative configurations, the (LP) spool 36 may be connected to the fan spool 38 via a speed reduction device 37 such as a reduction gear gearbox in an indirect-drive or geared-drive configuration. Such speed reduction devices may be included between any suitable shafts/spools within engine 10 as desired or required.

As shown in FIG. 1, the fan section 16 includes a plurality of fan blades 40 that are coupled to and that extend radially outwardly from the fan spool 38. An annular fan casing or nacelle 42 circumferentially surrounds the fan section 16 and/or at least a portion of the gas turbine engine 14. It should be appreciated by those of ordinary skill in the art that the nacelle 42 may be configured to be supported relative to the gas turbine engine 14 by a plurality of circumferentially-spaced outlet guide vanes 44. Moreover, a downstream section 46 of the nacelle 42 (downstream of the guide vanes 44) may extend over an outer portion of the gas turbine engine 14 so as to define a bypass airflow passage 48 therebetween.

Figure 2:
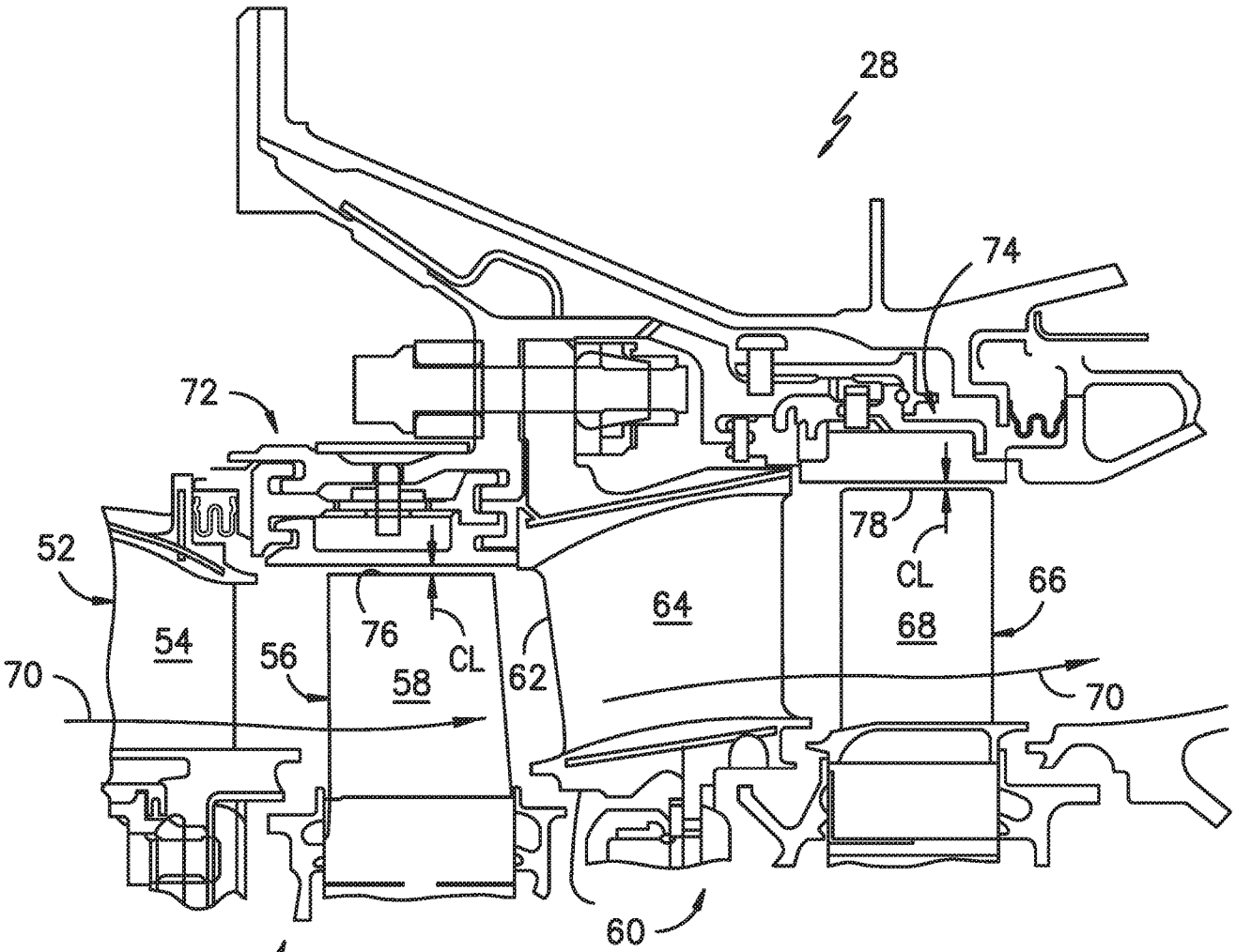
FIG. 2 is an enlarged circumferential cross sectional side view of a high pressure turbine portion of a gas turbine engine in accordance with an embodiment of the present disclosure.

FIG. 2 provides an enlarged cross sectioned view of the HP turbine 28 portion of the gas turbine engine 14 as shown in FIG. 1, as may incorporate various embodiments of the present invention. As shown in FIG. 2, the HP turbine 28 includes, in serial flow relationship, a first stage 50 which includes an annular array 52 of stator vane nozzles 54 (only one shown) axially spaced from an annular array 56 of turbine rotor blade assembly 58 (only one shown). The HP turbine 28 further includes a second stage 60 which includes an annular array 62 of stator vane nozzles 64 (only one shown) axially spaced from an annular array 66 of turbine rotor blades 68 (only one shown). The turbine rotor blade assemblies 58, 68 extend radially outwardly from and are coupled to the HP spool 34 (FIG. 1). As shown in FIG. 2, the stator vane nozzles 54, 64 and the turbine rotor blade assemblies 58, 68 at least partially define a hot gas path 70 for routing combustion gases from the combustion section 26 (FIG. 1) through the HP turbine 28.

As further shown in FIG. 2, the HP turbine may include one or more shroud assemblies, each of which forms an annular ring about an annular array of rotor nozzles. For example, a shroud assembly 72 may form an annular ring around the annular array 56 of rotor blade assembly 58 of the first stage 50, and a shroud assembly 74 may form an annular ring around the annular array 66 of turbine rotor blade assembly 68 of the second stage 60. In general, shrouds of the shroud assemblies 72, 74 are radially spaced from blade tips 76, 78 of each of the rotor blade assembly 68. A radial or clearance gap CL is defined between the blade tips 76, 78 and the shrouds.

Figure 3:
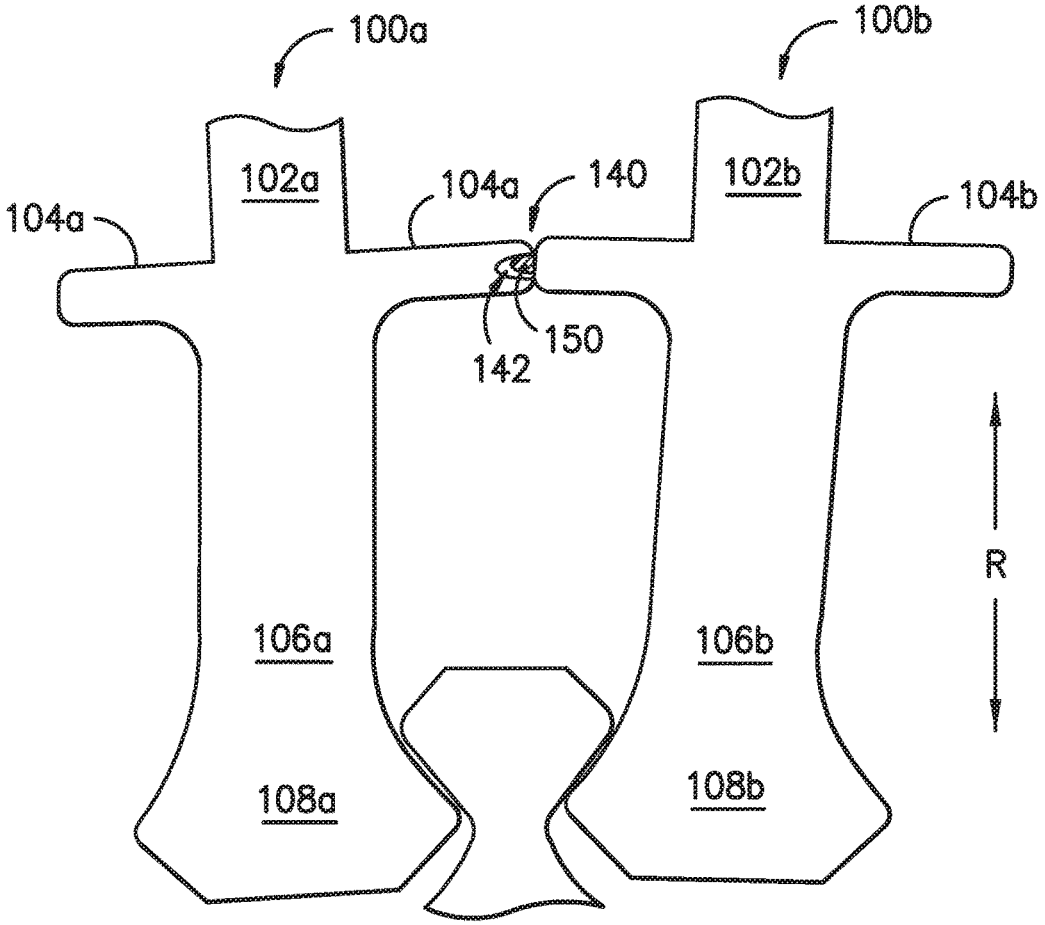
FIG. 3 is an axial view of two adjacent exemplary CMC rotor blade assemblies and an exemplary CMC.
Figure 9:
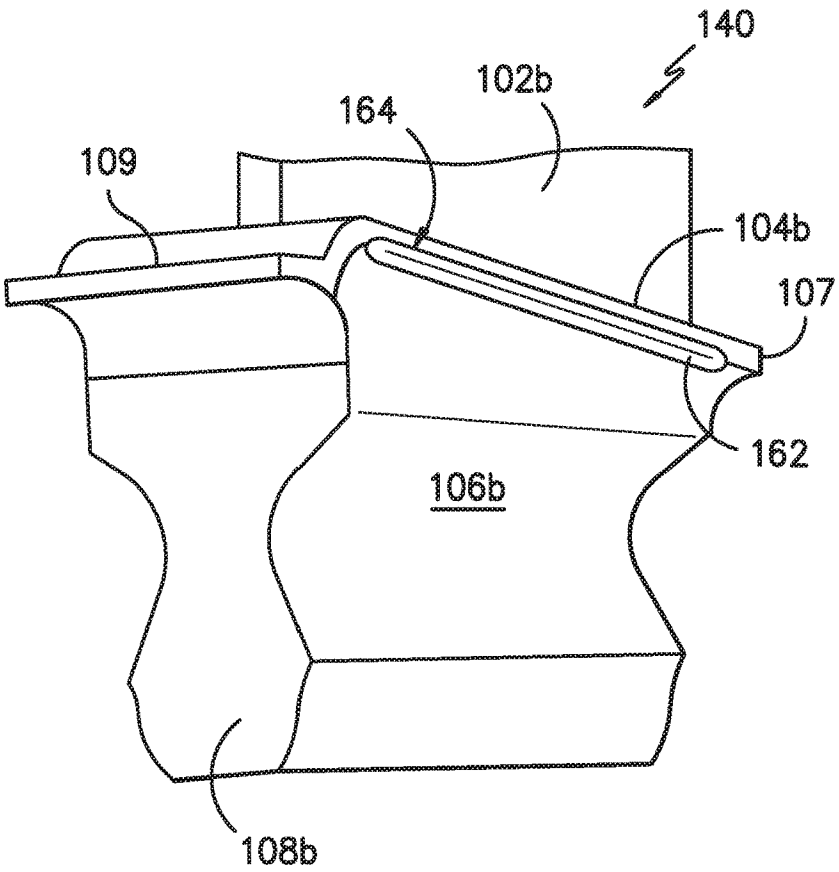
FIG. 9 is a perspective view of an exemplary triangular groove configured as a damper pocket on the CMC blade assembly platform.
Figure 8:
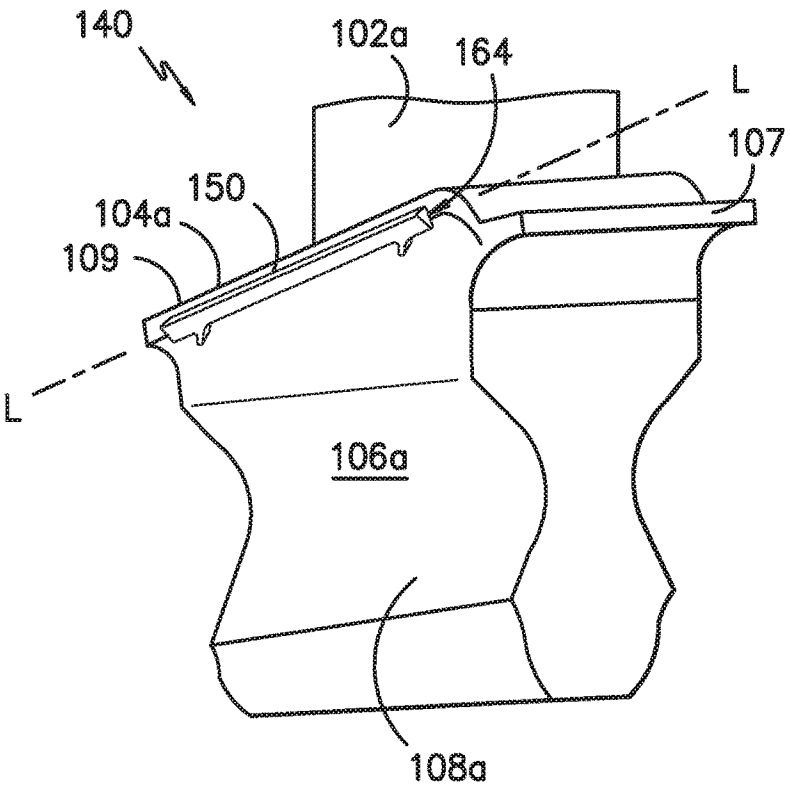
FIG. 8 is a perspective view an exemplary CMC turbine blade assembly showing the tabbed CMC damper.

Referring now to FIG. 3, a rotor blade assembly is depicted having a first CMC rotor blade assembly **102*a* and an adjacent second CMC rotor blade assembly 102*b*. The first CMC rotor blade assembly 102*a* has an airfoil portion 102*a*, a first platform portion 104*a*, and a shank portion 106*a* with a dovetail attachment mechanism 108*a*. Similarly, the second CMC rotor blade assembly 102*b* has an airfoil portion 102*b*, a second platform portion 104*b*, and a shank portion 106*b* with a dovetail attachment mechanism 108*b*. Both the first and second CMC rotor blade assemblies 100*a***,

100*b* also include an axially upstream, or forward angel wing 107 and an axially downstream, or aft angel wing 109 (see FIGS. 8 & 9).

During engine operation, vibrations are induced in and between the first and second CMC rotor blade assemblies 100*a*, 100*b* including side-to-side, i.e., circumferential movement of the platform portions 104*a*, 104*b* that increase excitation stresses induced in the shank portions 106*a*, 106*b*. A platform damping system 140 is positioned between adjacent portions of the platform portions 104*a*, 104*b*. In the exemplary embodiment shown, CMC rotor blade assemblies 100*a*, 100*b* are unitarily formed as a single component via those CMC fabrication processes known in the art. However, in other embodiments, the CMC rotor blade assemblies 100*a*, 100*b* may be formed from separate components.

Figure 5:
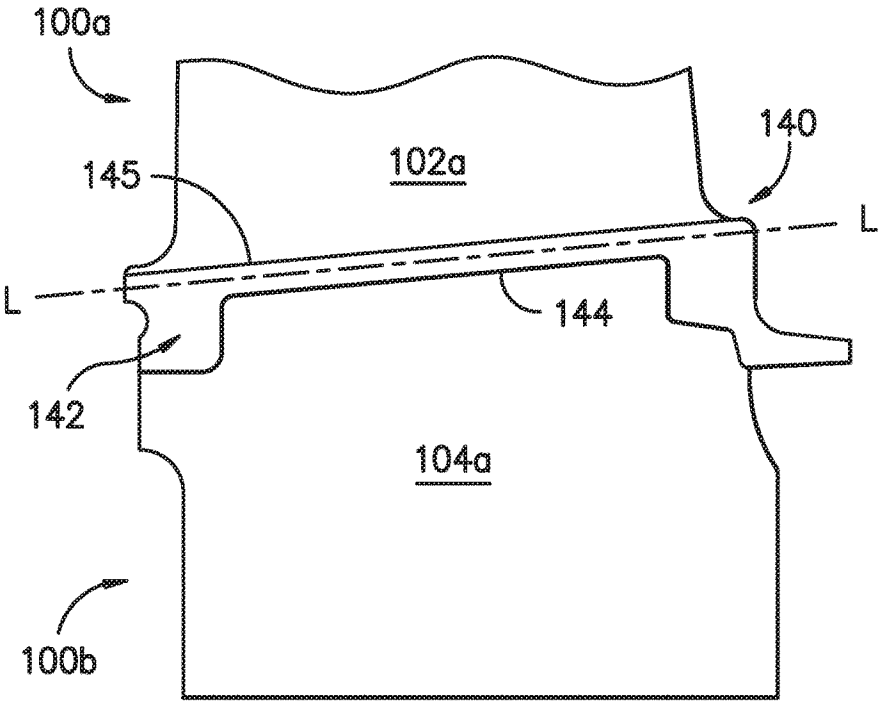
FIG. 5 is a plan view of an exemplary pocket formed between two adjacent platforms.
Figure 4:
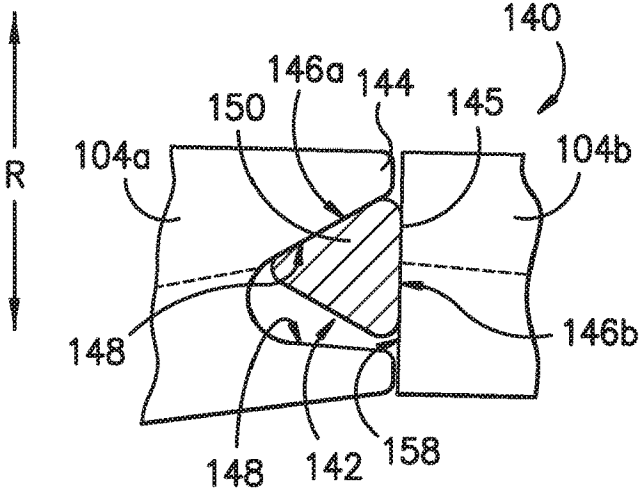
FIG. 4 is a sectional view of the exemplary CMC damper of FIG. 3 between the CMC rotor blade assemblies.

FIGS. 4 and 5 show an exemplary damping system 140 utilized between the adjacent first and second CMC rotor blade assemblies 100*a*, 100*b*. As shown in FIG. 4, a CMC wedge damper 150 is generally shown defining a substantially triangular shape. More particularly, for the depicted embodiment of FIG. 4, the CMC wedge damper 150 has a rounded corner, equilateral-triangular cross section as viewed along the longitudinal axis. Further, the CMC wedge damper 150 is positioned within a damper pocket 142 defined recessed within a first side 120 of the first platform portion 104*a* of the first CMC rotor blade assembly 100*a*. However, other shapes can be utilized with a corresponding pocket shape. For example, FIG. 7 shows a CMC wedge damper 150 having a substantially triangular shape and including a pair of tabs 152, 154, and the damper pocket 142 in FIG. 5 illustrates an exemplary shape to house the CMC wedge damper 150 shown in FIG. 7.

In the embodiments shown in FIGS. 4 and 5, the damper pocket 142 is defined recessed within the first side 144 of the first blade platform portion 104*a*. Through this positioning, the damper pocket 142 can allow for sufficient clearance between each pocket angled surface 148 and damper angled surface 146*a*, 146*b* of the CMC wedge damper 150 to allow for movement of the CMC wedge damper 150 within the damper pocket 142. When the CMC wedge damper 150 is propelled radially outward in the damper pocket 142 by centrifugal force, e.g., during operation of turbofan 10 (FIG. 1), the CMC wedge damper 150 assumes a consistent equilibrium position with one damper angled surface 146*a* slidingly engaging a pocket angled surface 148 (i.e., the outer pocket angled surface) and another or second damper angled surface 146*b* of the CMC wedge damper 150 slidingly engaging a radial surface 158 of a second side 145 of the second platform portion 104*b* of the adjacent second CMC rotor blade assembly 100*b*. In this way, vibrational energy in the CMC rotor blade assemblies 100*a*, 100*b* may be dissipated or absorbed by the CMC wedge damper 150. For this embodiment, the radial surface 158 of the second blade platform 104*b* extends substantially parallel to a radial direction R as shown best in FIG. 4. Further, as shown in FIG. 4, when the CMC wedge damper 150 is propelled radially outward within the damper pocket 142, the second angled surface 146*b* of the CMC wedge damper 150 is oriented substantially parallel to the radial direction R and slidingly engages the radial surface 158 of the second blade platform 104*b*. The damper pocket 142 in FIG. 5 illustrates an exemplary shape to house the wedge damper shown in FIG. 7, as noted above.

Figure 7:
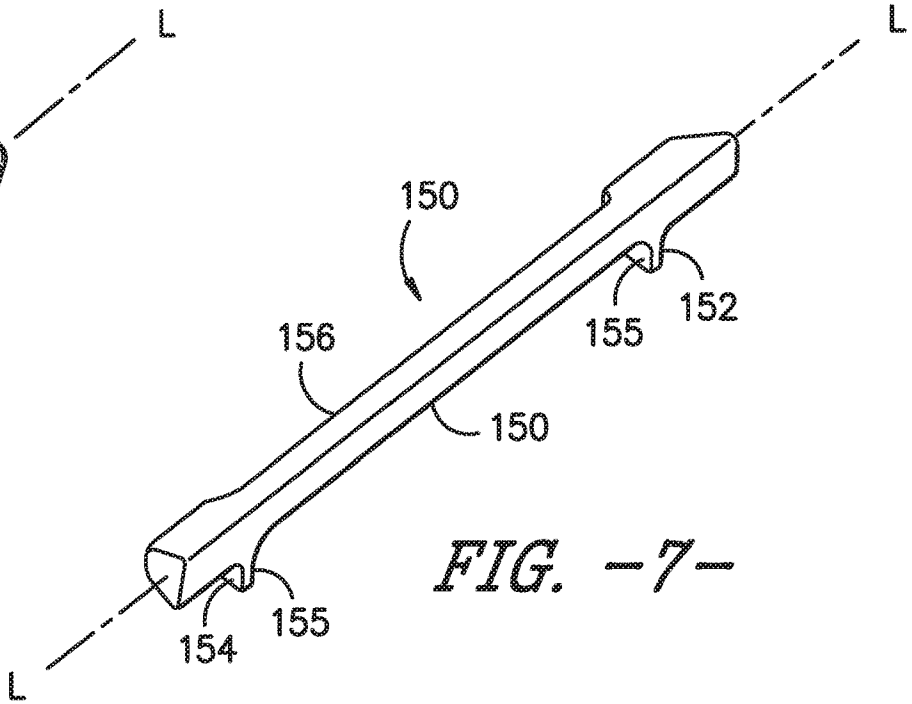
FIG. 7 is a perspective view of another exemplary embodiment of a CMC damper.
Figure 6:
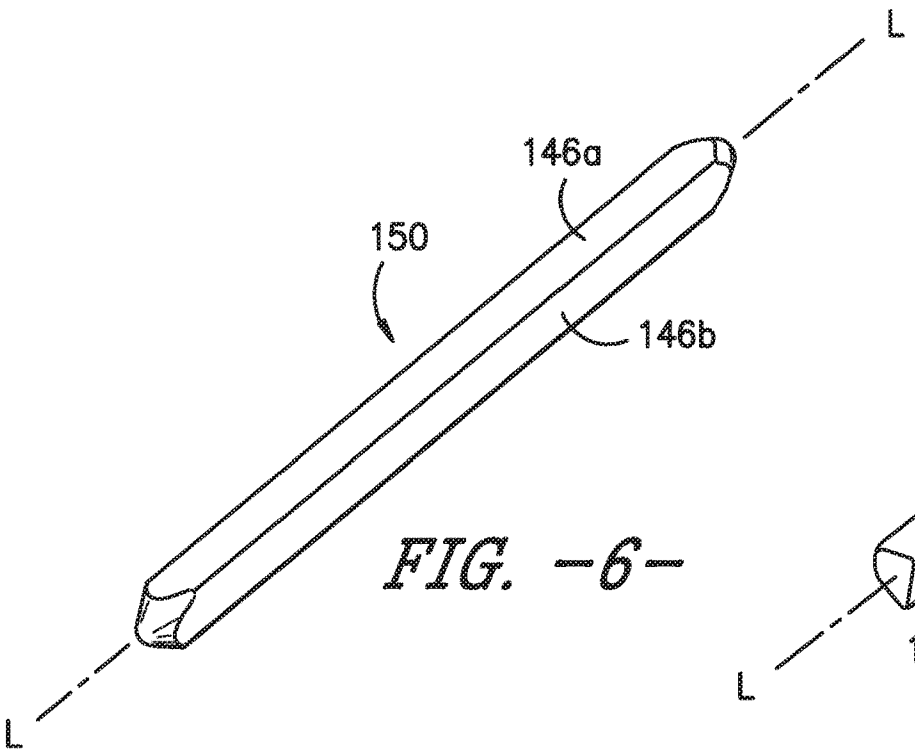
FIG. 6 is a perspective view of an exemplary embodiment of a CMC damper.

FIGS. 6 & 7 illustrate exemplary CMC wedge dampers 150. Each of the CMC wedge dampers 150 generally have a triangular shaped body extending along a longitudinal axis L with at least one damper angled surface 146 parallel to the longitudinal axis L. As seen in FIG. 7, the CMC wedge damper 150 can also have a leading tab 152, a trailing tab 154, and/or a notched corner 156. For the depicted embodiment of FIG. 7, the CMC wedge damper 150 defines the notched corner 156 extending between the leading tab and the trailing tab along a longitudinal direction extending parallel to the longitudinal axis L. The leading tab 152, trailing tab 154 and notched corner 156 can be configured to offset the center of gravity of the wedge damper 150 to help control the positioning of the CMC wedge damper 150 during use. Additionally, the leading tab 152 and trailing tab 154 can prevent the CMC wedge damper 150 from sliding out of the pocket in the longitudinal direction during turbine operation. As shown, the trailing tab 154 and leading tab 152 have at least one tab angled surface 155 transverse to the longitudinal axis L. The leading tab 152 can be formed with at least one of a contact prong and a rounded crown. The trailing tab 154 can also be formed to have a protrusion. However, other shapes can be utilized for the tabs 152, 154. Additionally, other features can be utilized on or within the body of the wedge damper 150.

Referring to FIGS. 8 & 9, two embodiments of the damping system 140 are shown that each include a triangular groove 162 formed into a flat vertical face 164 of first platform portion 104*a*. Triangular groove 162 can be formed by any method that enables operation of the damping system 140 as described herein. In the exemplary embodiment, CMC wedge damper 150 nests in the triangular groove 162 when installed. CMC wedge damper 150 is sized, configured, and oriented on a flat vertical face 164 of a first platform portion 104*a* to be at least partially received and retained within triangular groove 162 of an adjacent flat vertical face 164 of second platform portion 104*b*. Both the damper pocket 142 and triangular groove 162 are sized to receive and retain CMC wedge damper 150 without coupling methods such as welding, brazing, and fastener hardware.

In particular embodiments, the CMC wedge damper 150 is constructed from a CMC material that is similar to and/or compatible with the CMC material of the CMC rotor blade assemblies 100*a*, 100*b*. For example, the CMC material may be a silicon based, non-oxide ceramic matrix composite. As used herein, "CMCs" refers to silicon-containing, or oxide-oxide, matrix and reinforcing materials. Some examples of CMCs acceptable for use herein can include, but are not limited to, materials having a matrix and reinforcing fibers comprising non-oxide silicon-based materials such as silicon carbide, silicon nitride, silicon oxycarbides, silicon oxynitrides, and mixtures thereof. Examples include, but are not limited to, CMCs with silicon carbide matrix and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics.

An example of the damping performance of the CMC wedge damper 150 illustrates a new class of turbine blade vibratory damping response as compared to current metal dampers. Modeling results for the new CMC wedge damper determined that scaling up the damper stiffness to simulate the CMC material with a modulus ratio of 40.3/13=3.1, and scaling down the mass of the damper to simulate the CMC material with a density ratio of 0.102/0.317=0.32, the CMC wedge damper provided at least four times the undamped critical location vibratory response stress reduction of an otherwise identical damper but for being made from metals comprising superalloys of aluminum, iron, nickel, titanium, cobalt, chromium or mixtures thereof. These results apply for an undamped critical location stress of at least 4000 psi.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A damping system for a rotor blade platform assembly, comprising:

a first blade platform defining a damper pocket recessed within a first side of the blade platform, wherein the damper pocket has a pocket angled surface;

a second blade platform positioned adjacent the first blade platform, the second blade platform having a second side with a radial surface extending substantially parallel to a radial direction; and a CMC wedge damper positioned within the damper pocket and having a leading tab, a trailing tab, and at least one damper angled surface parallel to a longitudinal axis, and wherein when the CMC wedge damper is propelled radially outward within the damper pocket, the damper angled surface slidingly engages the pocket angle surface of the first blade platform and the CMC wedge damper slidingly engages the radial surface of the second blade platform, and wherein the CMC wedge damper defines a notched corner extending between the leading tab and the trailing tab along a longitudinal direction extending parallel to the longitudinal axis.

2. The damping system of claim 1, wherein the CMC wedge damper provides at least four times the undamped critical location vibratory response stress reduction of an otherwise identical damper but for being made from metals comprising superalloys of aluminum, iron, nickel, titanium, cobalt, chromium or mixtures thereof.

3. The damping system of claim 1, wherein an undamped critical location stress is at least 4000 psi.

4. The damping system of claim 1, wherein the leading tab comprises at least one of a contact prong and a rounded crown.

5. The damping system of claim 1, wherein the trailing tab comprises a protrusion.

6. The damping system of claim 1, wherein the CMC wedge damper has a second angled surface that is oriented substantially parallel to the radial direction and slidingly engages the radial surface of the second blade platform when the CMC wedge damper is propelled radially outward within the damper pocket.

7. The damping system of claim 1, wherein the CMC wedge damper has a rounded corner, equilateral-triangular cross section as viewed along the longitudinal axis.

8. A damping system for a turbine blade platform assembly, comprising:

a blade platform defining a damper pocket recessed within a first side of the blade platform, wherein the damper pocket has a pocket angled surface;

a second blade platform positioned adjacent the first blade platform, the second blade platform having a second side with a radial surface that is substantially parallel to a radial direction; and a CMC wedge damper positioned within the damper pocket and having a leading tab, a trailing tab, and at least one damper angled surface parallel to a longitudinal axis, and wherein the trailing tab and the leading tab each have at least one tab angled surface transverse to the longitudinal axis, and wherein when the CMC wedge damper is propelled radially outward within the damper pocket, the damper angled surface slidingly engages the pocket angle surface of the first blade platform and the CMC wedge damper slidingly engages the radial surface of the second blade platform, and wherein the CMC wedge damper defines a notched corner extending between the leading tab and the trailing tab along a longitudinal direction extending parallel to the longitudinal axis.

9. The damping system of claim 8, wherein the CMC wedge damper comprises an offset center of gravity.

10. The damping system of claim 8, wherein the CMC wedge damper is at least partially received and retained within damper pocket.

11. The damping system of claim 8, wherein the leading tab comprises at least one of a contact prong and a rounded crown.

12. The damping system of claim 8, wherein the trailing tab comprises a protrusion.

13. The damping system of claim 8, wherein the CMC wedge damper has a second angled surface that is oriented substantially parallel to the radial direction and slidingly engages the radial surface of the second blade platform when the CMC wedge damper is propelled radially outward within the damper pocket.

* * * * *